US007431471B1

(12) United States Patent
Wade

(10) Patent No.: US 7,431,471 B1
(45) Date of Patent: Oct. 7, 2008

(54) LIGHTING APPARATUS FOR EQUINE ANIMALS

(76) Inventor: Belinda Wade, 25608 - 19th St., San Bernadino, CA (US) 92404

( * ) Notice: Subject to any disclaimer, the term of this patent is extended or adjusted under 35 U.S.C. 154(b) by 148 days.

(21) Appl. No.: 11/387,406

(22) Filed: Mar. 23, 2006

(51) Int. Cl.
*F21V 21/08* (2006.01)
*B68B 3/14* (2006.01)

(52) U.S. Cl. ..... 362/103; 362/108; 362/253; 54/20

(58) Field of Classification Search ..... 362/103, 362/108, 191, 253; 40/303; 54/20, 24
See application file for complete search history.

(56) References Cited

U.S. PATENT DOCUMENTS 3,935,443 A * 1/1976 Simmons ..... 362/108
4,173,201 A * 11/1979 Chao et al. ..... 119/859
4,909,189 A * 3/1990 Minotti ..... 119/859
6,574,948 B2 * 6/2003 Longtin ..... 54/79.2
2005/0044823 A1 * 3/2005 Collins ..... 54/6.1
2007/0086182 A1 * 4/2007 Kelly ..... 362/108

* cited by examiner

*Primary Examiner*—Stephen F Husar
*Assistant Examiner*—Peggy A. Neils

(57) ABSTRACT

A lighting apparatus for equine animals for use in low light or no light conditions is provided. The lighting apparatus comprises a backing material and a perimeter material secured to the backing material with the perimeter material having an aperture. A compartment is secured within the aperture of the perimeter material. At least one power source is contained within the compartment. A compartment cover covers the power source. At least one light source is electrically connected to the power source above the compartment cover. A cover covers the light bulb. An activation mechanism adjacent the cover illuminates the light source.

17 Claims, 5 Drawing Sheets

11
10
20
21
20
13

13
10
21

LIGHTING APPARATUS FOR EQUINE ANIMALS

BACKGROUND OF THE INVENTION

1. Field of the Invention

This invention relates generally to a lighting apparatus for equine animals and, more particularly, the invention relates to a lighting apparatus for equine animals that effectively illuminates the front and rear of an equine animal for increased visual safety.

2. Description of the Prior Art

People have used horses for thousands of years. In the United States, they were once the primary mode of transportation. Horses helped in hunting, carrying hunters quickly over distances in search of game. Horses were also employed during wartime to take soldiers into battle, used by pioneers to settle the West, and ridden by postal workers in the Pony Express to deliver mail. Today, horses are utilized mainly for recreation and sport, but they are no less loved and needed than they were in the past. Nationwide, an estimated 2.9 million horses are used for recreation, with 4.3 million riders riding each year. According to a recent study, recreational horseback riding adds $23.8 billion to the U.S. economy, and the industry spurs 317,000 full-time jobs. As many aficionados would readily attest, there is little more invigorating than riding horseback across open fields with the wind whipping through the hair, feeling daring, fearless, and free.

The use of horses as a means of transport is of a bygone era, but with many horses being ridden on the roads for leisure purposes, the safety of horse riders is a matter for all road users. The vulnerability of horse and rider is not helped by their natural camouflage, and a dark colored horse being ridden in the shade on a tree-lined road will not be seen easily by a driver. Especially at night, the dangers of horseback riding increase exponentially. While riders may be extremely careful when navigating their animal in the dark, the risk of being struck by a vehicle is constant.

SUMMARY

The present invention includes a lighting apparatus for equine animals for use in low light or no light conditions. The lighting apparatus comprises a backing material and a perimeter material secured to the backing material with the perimeter material having an aperture. A compartment is secured within the aperture of the perimeter material. At least one power source is contained within the compartment. A compartment cover covers the power source. At least one light source is electrically connected to the power source above the compartment cover. A cover covers the light bulb. An activation mechanism adjacent the cover illuminates the light source.

In addition, the present invention includes a method for illuminating equine animals in low light or no light conditions. The method comprises providing a backing material, securing a perimeter material to the backing material, forming an aperture in the perimeter material, securing a compartment within the aperture of the perimeter material, mounting at least one power source within the compartment, covering the power source, electrically connecting at least one light source to the power source above the compartment cover, covering the light bulb, and activating the light source.

The present invention further includes a lighting apparatus for equine animals for use in low light or no light conditions. The lighting apparatus comprises a battery compartment secured to the equine animal with at least one power source contained within the compartment. At least one light source is electrically connected to the power source above the compartment cover. Activation means adjacent the cover illuminates the light source.

DETAILED DESCRIPTION OF THE PREFERRED EMBODIMENTS

Figure 1:
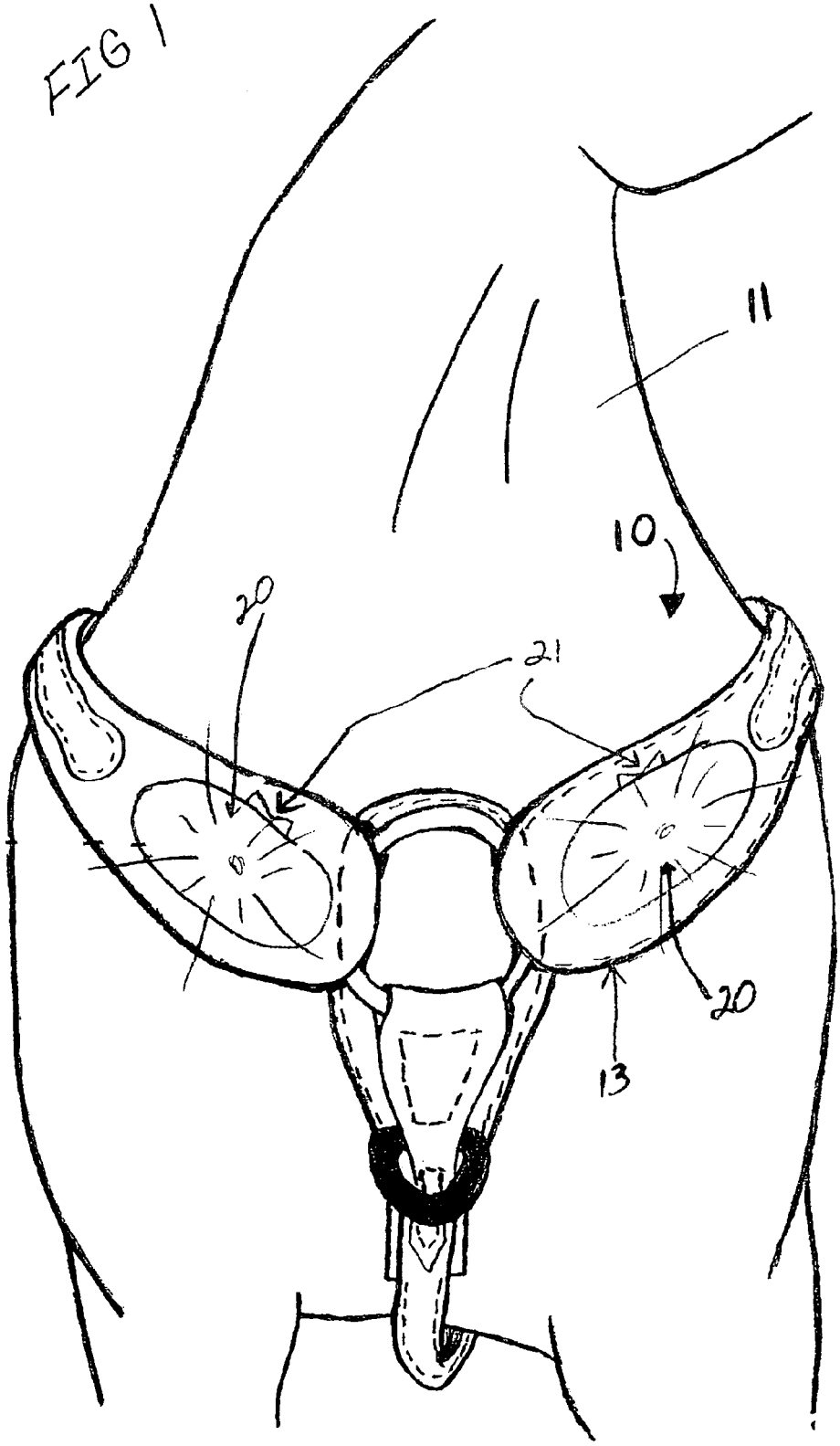
FIG. 1 is a front view illustrating a breast collar of a lighting apparatus for equine animals, constructed in accordance with the present invention.
Figure 2:
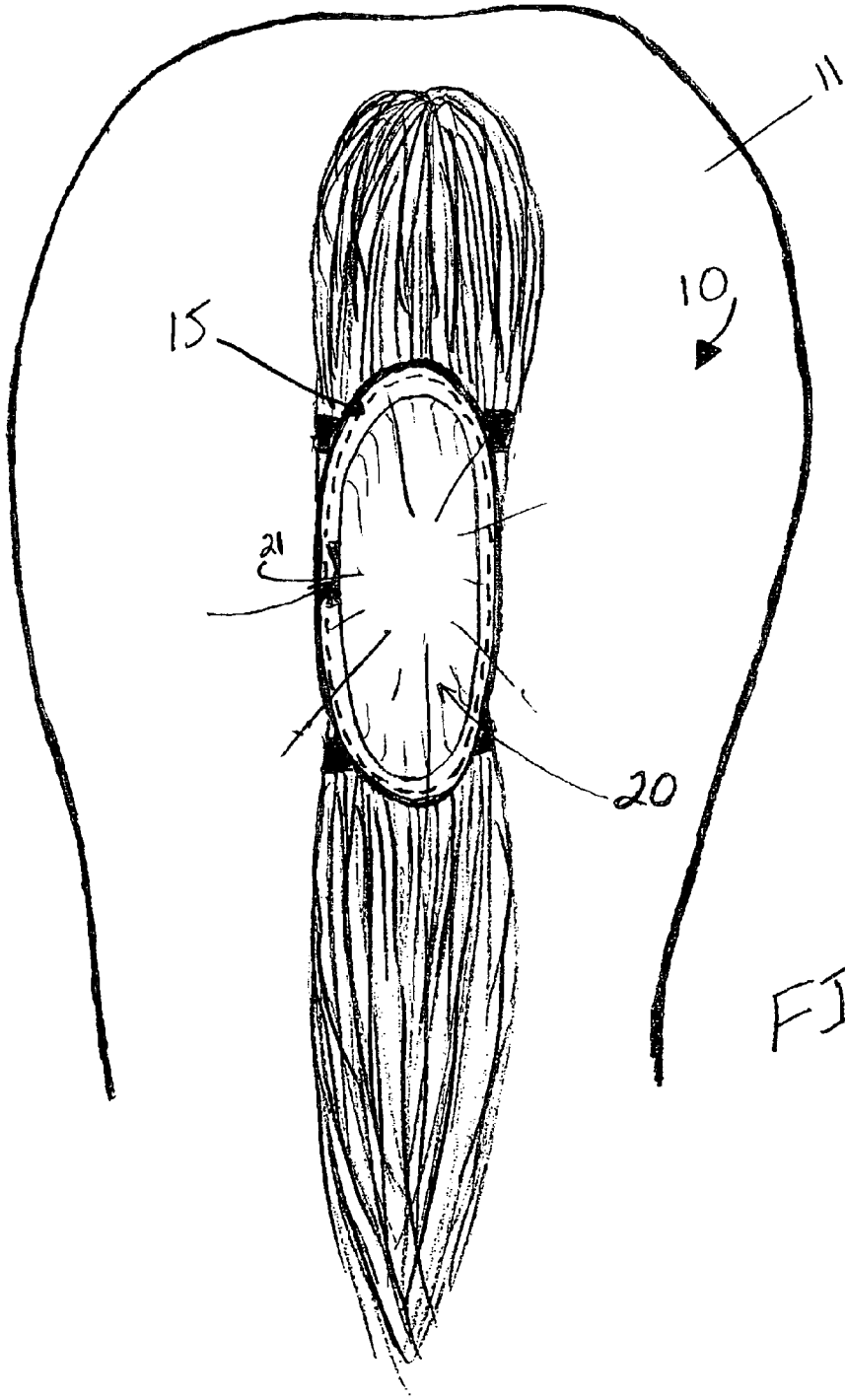
FIG. 2 is a front view illustrating a tail strap of the lighting apparatus for equine animals, constructed in accordance with the present invention, with the light cover.
Figure 4:
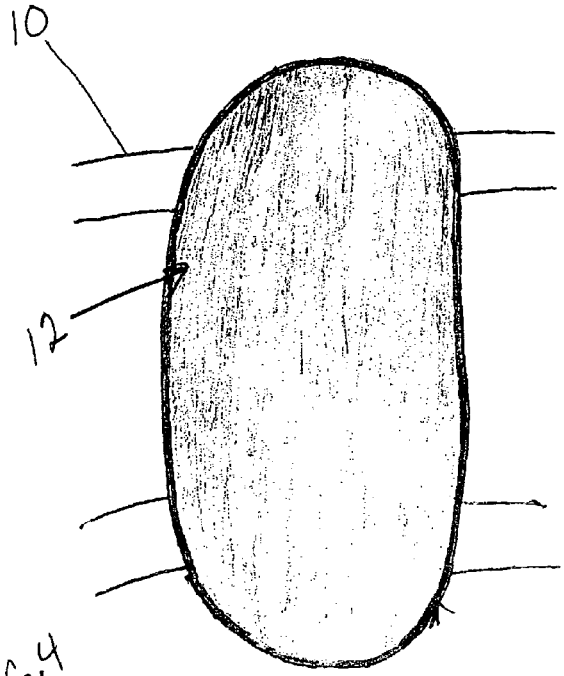
FIG. 4 is a front view illustrating a leather backing of the lighting apparatus for equine animals, constructed in accordance with the present invention.
Figure 5:
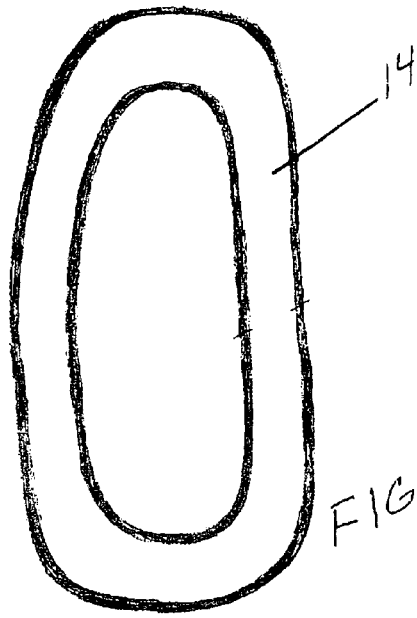
FIG. 5 is a front view illustrating the perimeter leather of the lighting apparatus for equine animals, constructed in accordance with the present invention.
Figure 3:
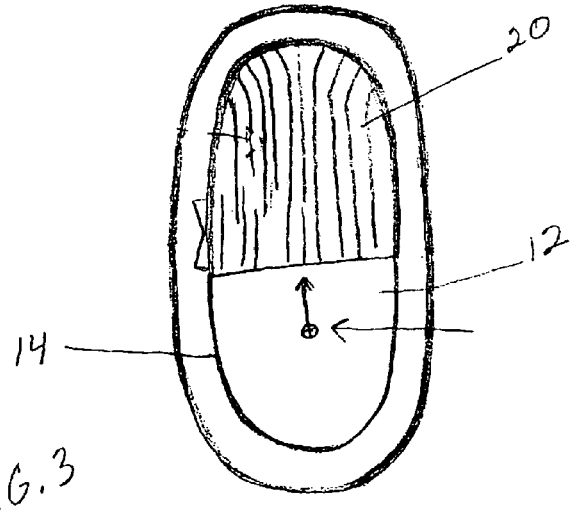
FIG. 3 is a front view illustrating the lighting apparatus for equine animals, constructed in accordance with the present invention, with the light secured to the thin piece of leather.
Figure 6:
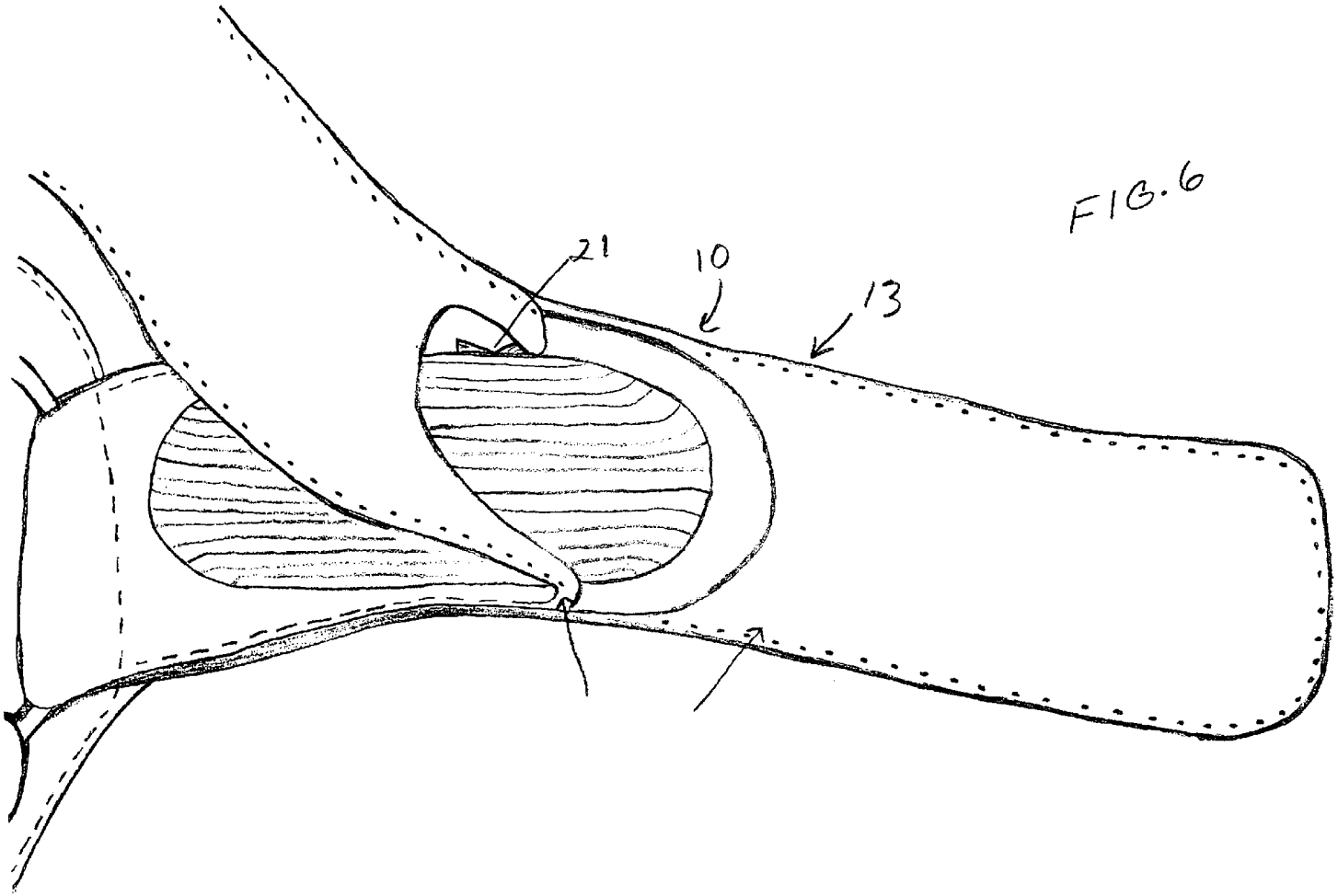
FIG. 6 is a perspective view illustrating the breast collar of the lighting apparatus for equine animals, constructed in accordance with the present invention.
Figure 7:
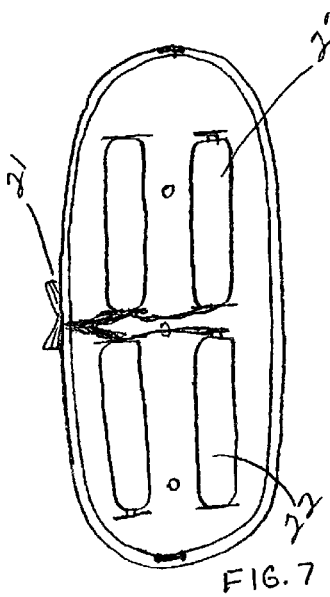
FIG. 7 is a front view illustrating the battery compartment of the lighting apparatus for equine animals, constructed in accordance with the present invention.
Figure 8:
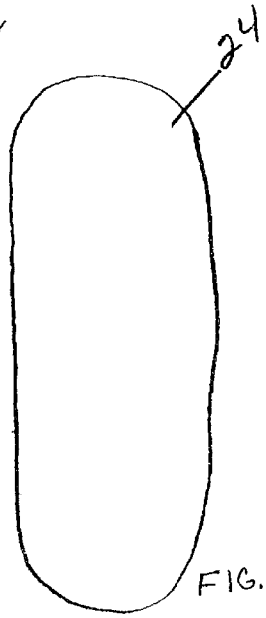
FIG. 8 is a front view illustrating the reflective battery compartment cover of the lighting apparatus for equine animals, constructed in accordance with the present invention.
Figure 9:
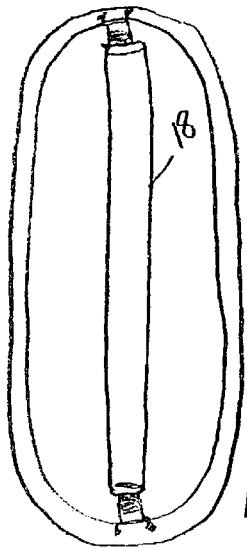
FIG. 9 is front view illustrating an embodiment of the light bulb of the lighting apparatus for equine animals, constructed in accordance with the present invention.
Figure 10:
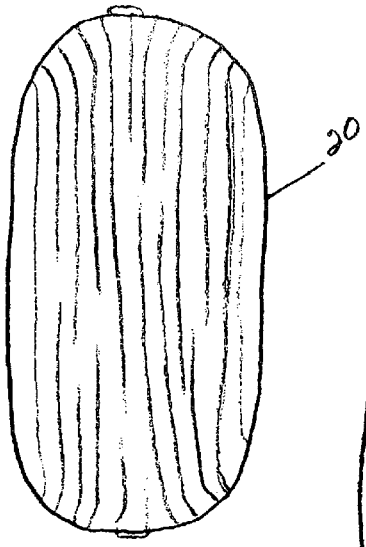
FIG. 10 is a front view illustrating the light cover of the lighting apparatus for equine animals, constructed in accordance with the present invention.
Figure 11:
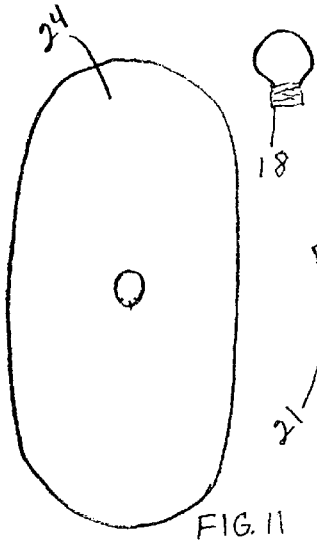
FIGS. 11 and 12 are front views illustrating another embodiment of the light bulb of the lighting apparatus for equine animals, constructed in accordance with the present invention.
Figure 12:
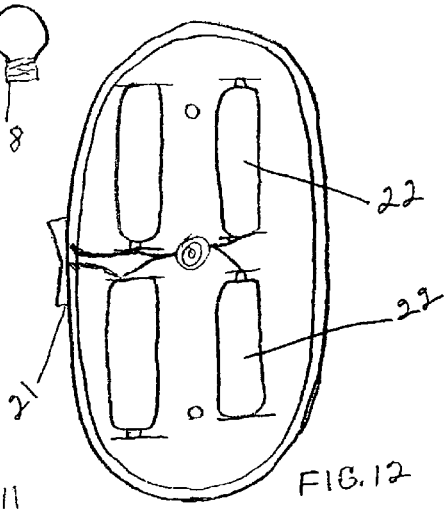

As illustrated in FIGS. 1-12, the present invention is a lighting apparatus, indicated generally at 10, for equine animals 11. It should be noted that while the lighting apparatus 10 of the present invention will be described as being used for equine animals, it is within the scope of the present invention for the lighting apparatus 10 to be used with any type of animal in low light and no light conditions.

Basically, the lighting apparatus 10 of the present invention can be used on a set of breast straps 13 and tail straps 15 for horses 11 for allowing the horses 11 to be seen in low light and no light conditions. The lighting apparatus 10 includes a backing material 12 with a perimeter material 14 sewn or otherwise secured to the backing material 12. The perimeter material 14 includes an aperture or hole 16 for receiving the components of the lighting apparatus 10. The actual components of the lighting apparatus will be described in further detail below.

Preferably, the backing material 12 and the perimeter material 14 are constructed from a durable leather material although constructing the backing material and/or the perimeter material 14 from other materials is within the scope of the present invention. The lighting apparatus 10, when constructed, resemble the straps that are commonly used to outfit horses, yet feature a combination of buckles and straps of the hook and loop system commonly known as Velcro to ensure a secure and comfortable fit for the animal.

Centrally positioned on the left and right of the breast collar 13 and on the tail strap 15, the lighting apparatus 10 includes a bright, compact, incandescent light bulb 18 internally contained within a durable plastic protective light bulb cover 20. It should be noted that it is within the scope of the present invention to use any type of light bulb 18 and the present invention is not limited to an incandescent light bulb.

The light bulb cover 20 of the lighting apparatus 10 can be constructed from a clear material or a colored material depending on the desires of the user. Preferably, the light bulbs 18 preferably operate at 1.35 volts/0.75 amps and are activated by a sliding on/off switch 21 located next to the light covering 20 on the exterior of the straps. Once again, while the light bulbs 18 of the present invention have been and will be described as operating at a particular voltage and amperage, it is within the scope of the present invention for the light bulbs 18 to operate at different voltages and amperages.

The lighting apparatus 10 of the present invention further includes a power source 22 electrically connected and providing power to the light bulbs 18. Preferably, the power source 22 is an internally contained battery or batteries such as a standard 9 volt or AA alkaline battery although using any type of power source 22 is within the scope of the present invention.

In addition, the lighting apparatus 10 of the present invention includes a power source cover 24 covering the power source 22. Preferably, the power source cover 24 is constructed from a silver reflecting material for increasing the illumination of the light bulbs 18 although constructing the power source cover 24 from other materials is within the scope of the present invention.

The use of the lighting apparatus 10 of the present invention will now be described. It will be understood by those persons skilled in the art that the manner of use described herein is merely one manner of use and other manners of use are within the scope of the present invention.

Before leaving the safety of the corral or field, the user outfits the horse in the usual manner, adding the lighting apparatus 10 with the special breast collar 13 and tail strap 15. Before mounting the animal, each switch 21 on the straps would be turned to the "on" position. In this manner, each front side of the horse, as well as the rear, projects a brilliant glow that can be seen from a distance. While the rider navigates the horse through the darkness, the lighting apparatus 10 sends a visual signal to approaching vehicles warning of the presence of the equestrian and the animal.

The lighting apparatus 10 of the present invention has many advantages. Foremost, the lighting apparatus 10 provides an effective means of ensuring increased safety of riders and horses when riding at night or low light conditions. With luminous lights incorporated into an attractive set of leather breast straps 13 and tail straps 15, the lighting apparatus 10 allows equestrians and their animals easily visible after the sun has set. As a result, any traffic encountered has ample warning of approaching horseback riders, thus avoiding a tragic accident. While the lighting apparatus 10 of the present invention provides increased safety, it is a versatile set of horse wear ideal for use in horse shown and even races, lending a flashy appearance to the proceedings. Made of durable, high quality materials, the lighting apparatus withstands many years of continued use. Furthermore, the lighting apparatus 10 is useful for search and rescue teams on horse back, as well as on harnesses to pull carts and wagons.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A lighting apparatus for equine animals for use in low light or no light conditions, the equine animals having a front side and a rear side, the rear side having a tail, the lighting apparatus comprising:

a backing material;

a perimeter material secured to the backing material, the perimeter material having an aperture;

a compartment secured within the aperture of the perimeter material;

at least one power source contained within the compartment;

a compartment cover covering the power source;

at least one first light source electrically connected to the power source, each first light source mounted on the front side of the animal, each first light source directing light directly away from the front of the animal;

at least one second light source electrically connected to the power source, each second light source mounted on the rear side of the animal about the tail of the animal, each second light source directing light directly away from the rear of the animal;

a cover covering each light source; and activation means adjacent the cover for illuminating each of the light sources.

2. The lighting apparatus of claim 1 wherein the backing material and the perimeter material are constructed from a durable leather material.

3. The lighting apparatus of claim 1 wherein the power source is at least one battery.

4. The lighting apparatus of claim 1 wherein each the light source is at least one light bulb.

5. The lighting apparatus of claim 1 wherein the cover is selected from the group consisting of clear, red, and yellow.

6. The lighting apparatus of claim 1 wherein the activation means is an on/off switch secured to the compartment.

7. The lighting apparatus of claim 1 and further comprising:

securing means for securing the backing material to an equine animal.

8. The lighting apparatus of claim 1 wherein the securing means is a plurality of straps having hook and loop fasteners.

9. The lighting apparatus of claim 1 wherein the power source cover is constructed from a silver reflecting material.

10. A method for illuminating equine animals in low light or no light conditions, the equine animals having a front side and a rear side, the rear side having a tail, the method comprising:

providing a backing material;

securing a perimeter material to the backing material;

forming an aperture in the perimeter material;

securing a compartment within the aperture of the perimeter material;

mounting at least one power source within the compartment;

covering the power source;

electrically connecting at least one first light source to the power source;

mounting each first light source to the front of the animal;

directing light from each first light source directly away from the front of the animal;

electrically connecting at least one second light source to the power source;

mounting each second light source on the rear side of the animal about the tail of the animal;

directing light from each second light source directly away from the rear of the animal;

covering each of the light sources; and activating the light sources.

11. The method of claim 10 and further comprising:

constructing the backing material and the perimeter material from a durable leather material.

12. The method of claim 10 wherein the power source is at least one battery.

13. The method of claim 10 wherein each light source is at least one light bulb.

14. The method of claim 10 and further comprising:

covering the light source with a cover selected from the group consisting of clear, red, and yellow.

15. The method of claim 10 and further comprising:

activating the light source with an on/off switch secured to the compartment.

16. The method of claim 10 and further comprising:

securing the backing material to an equine animal.

17. The method of claim 10 and further comprising:

covering the power source with a cover constructed from a silver reflecting material.

* * * * *